US005655500A

United States Patent [19]

Kato

[11] Patent Number: 5,655,500

[45] Date of Patent: Aug. 12, 1997

[54] CONTROL SENSORS FOR FUEL-INJECTED ENGINE

[75] Inventor: Masahiko Kato, Hamamatsu, Japan

[73] Assignee: Sanshin Kogyo Kabushiki Kaisha, Shizuoka-Ken, Japan

[21] Appl. No.: 667,403

[22] Filed: Jun. 21, 1996

[30] Foreign Application Priority Data

Jun. 21, 1995 [JP] Japan ..... 7-154980

[51] Int. Cl.[6] ..... F02D 9/00

[52] U.S. Cl. ..... 123/336

[58] Field of Search ..... 123/336, 595, 123/583; 137/595, 601; 251/228, 274, 305; 74/108, 581

[56] References Cited

U.S. PATENT DOCUMENTS

| | | | |
|---|---|---|---|
| 5,517,963 | 5/1996 | Yoshida et al. | 123/336 |
| 5,535,718 | 7/1996 | Nakai et al. | 123/336 |
| 5,542,388 | 8/1996 | Ichinose et al. | 123/336 |

*Primary Examiner*—Raymond A. Nelli
*Attorney, Agent, or Firm*—Knobbe, Martens, Olson & Bear, LLP

[57] ABSTRACT

A fuel-injected engine produces improved performance while reducing hydrocarbon emissions through the use of several control sensors. One of the sensors, a throttle sensor, determines an opening degree of the throttle valves of the engine and transmits this information to an electronic control unit. A unique coupling ensures unitary movement of a shaft of the sensor with the throttle valve to precisely measure the opening degree and to minimize mechanical hysteresis in the sensed position of the throttle valve as the valve opens and closes. The electronic control unit in turn adjusts the amount of fuel injected depending upon the opening degree of the throttle valves. The amount of injected fuel also depends upon the atmospheric pressure to which the engine is subject. A high-pressure fuel delivery circuit includes a fuel pressure regulator that regulates the fuel pressure at the fuel injectors of the engine. The pressure regulator includes an altitude compensator that adjusts the amount of pressure at fuel injectors according to the atmospheric pressure sensed in the intake manifold. By controlling the opening time of the fuel injectors and the fuel pressure at the injectors, the engine control unit can precisely control the fuel/air mixture delivered to the combustion chambers of the engine to improve engine performance and reduce hydrocarbon emissions.

30 Claims, 7 Drawing Sheets

CONTROL SENSORS FOR FUEL-INJECTED ENGINE

BACKGROUND OF THE INVENTION

1. Field of the Invention

The present invention relates in general to an engine, and more particularly to control sensors of a marine engine used to precisely control the fuel/air mixture delivered to combustion chambers of the engine.

2. Description of Related Art

Several outboard motors recently have become equipped with engine control systems in response to increased concerns of hydrocarbon emissions. Such systems closely monitor and control the fuel/air ratio of the fuel charge delivered to each cylinder of the engine. The engine control system can significantly reduce hydrocarbon emissions, while improving fuel economy and engine performance.

An engine control system often includes a throttle sensor which detects the opening degree of a throttle device associated with the engine. For instance, such prior throttle sensor detects the angular position of the throttle valves and sends a signal indicative of the throttle valve position to an electronic control unit of the engine control system. The electronic control unit uses this information to determine the intake airflow rate into the cylinders of the engine and to adjust the amount of fuel delivered to the engine cylinders to obtain a desired fuel/air ratio.

Prior throttle sensors often are directly attached to the intake manifold or throttle body and are coupled to the throttle shaft. A thin band commonly connects a shaft of the throttle sensor to the throttle shaft. The use of this type of coupling, however, in the conventional mounting arrangement produces several disadvantages.

As a result of the direct coupling provided by the thin band, the thin band absorbs engine vibrations which it transmits to the throttle sensor. Such vibrations negatively effect the performance of the throttle sensor. In addition, the thin band commonly twists slightly when the throttle shaft rotates. The shaft of the throttle sensor thus follows the throttle shaft with a slight delay. As a result, hysteresis occurs in the sensed position of the throttle shafts as the throttle valves open and close which produces inaccuracies in the sensed position of the throttle valves.

The thin band also is susceptible to thermal deformation from engine heat conducted through the throttle shaft. Such thermal expansion and contraction introduces additional inaccuracies in the sensed valve position and exacerbates the hysteresis that occurs as the throttle valves open and close.

In addition, the use of a throttle sensor alone does not allow for precise control of the fuel/air mixture delivered to the cylinders of the engine. As noted above, the engine control system uses the sensed opening degree of the throttle valves to determine the time duration for which the fuel injectors should be opened in order to produce the desired fuel/air ratio. The amount of injected fuel, however, also depends upon the pressure differential between the fuel pressure within the injector and the atmospheric air pressure within the manifold. If the engine control system assumes a constant atmospheric air pressure and the fuel system does not adjust for changes in atmospheric air pressure, the engine control system cannot precisely control the fuel/air mixture when the watercraft is operated at various altitudes, such as, for example, when the watercraft is operated both in an ocean and in a mountain lake.

SUMMARY OF THE INVENTION

A need therefore exists for an engine with improved control sensors to precisely sense the opening degree of a throttle device of an engine, as well as to compensate for periodic changes in atmospheric pressure produced by operating the engine at various altitudes. The engine desirably includes a coupling between the throttle sensor and the throttle shaft which ensures unitary movement of the sensor with the throttle device for precise measurements of the opening degree and to minimize mechanical hysteresis in the sensed position of the throttle device as the valve opens and closes.

One aspect of the present invention thus involves an engine comprising an induction system. The induction system includes a plurality of throttle devices which a linkage system interconnects. Each throttle device of the induction system comprises a throttle shaft that rotates to establish an opening degree of the throttle device. A throttle sensor is used to sense the opening degree. The throttle sensor has a rotatable sensor shaft. Means also are provided for transferring reciprocating rotational movement of one of the throttle shafts to the sensor shaft without producing mechanical hysteresis.

In accordance with another aspect of the present invention, a coupling is provided between a sensor and an operator of an engine control device which moves between at least two positions. The coupling comprises a driver attached to the operator and a follower attached to the sensor. The follower and the driver cooperate with each other to transfer movement of the operator to the sensor. A biasing member is provided between the driver and the follower to bias the follower to follow movement of the driver.

An additional aspect of the present invention involves an engine comprising an induction system which includes at least one throttle device. The throttle device comprises a throttle shaft that rotates to establish an opening degree of the throttle device. A sensor comprises a rotatable sensor shaft and a coupling which interconnects the sensor shaft to the throttle shaft such that the sensor shaft rotates with the throttle shaft in a unitary manner. The coupling comprises a driver attached to the throttle shaft and a follower attached to the sensor shaft. The driver and the follower include interengaging elements which connect the follower to the driver such that the follower rotates with the driver. A biasing member is provided between the driver and the follower to bias the follower to follow rotational movement of the driver.

In accordance with another aspect of the invention, an engine comprises an induction system. The induction system includes a plurality of intake passages and at least one fuel injector. The fuel injector communicates with at least a first intake passage of the plurality of intake passages at an injection point. A fuel delivery system communicates with the fuel injector. The fuel delivery system includes a pressure regulator which communicates with at least the first intake passage at the point of injection.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
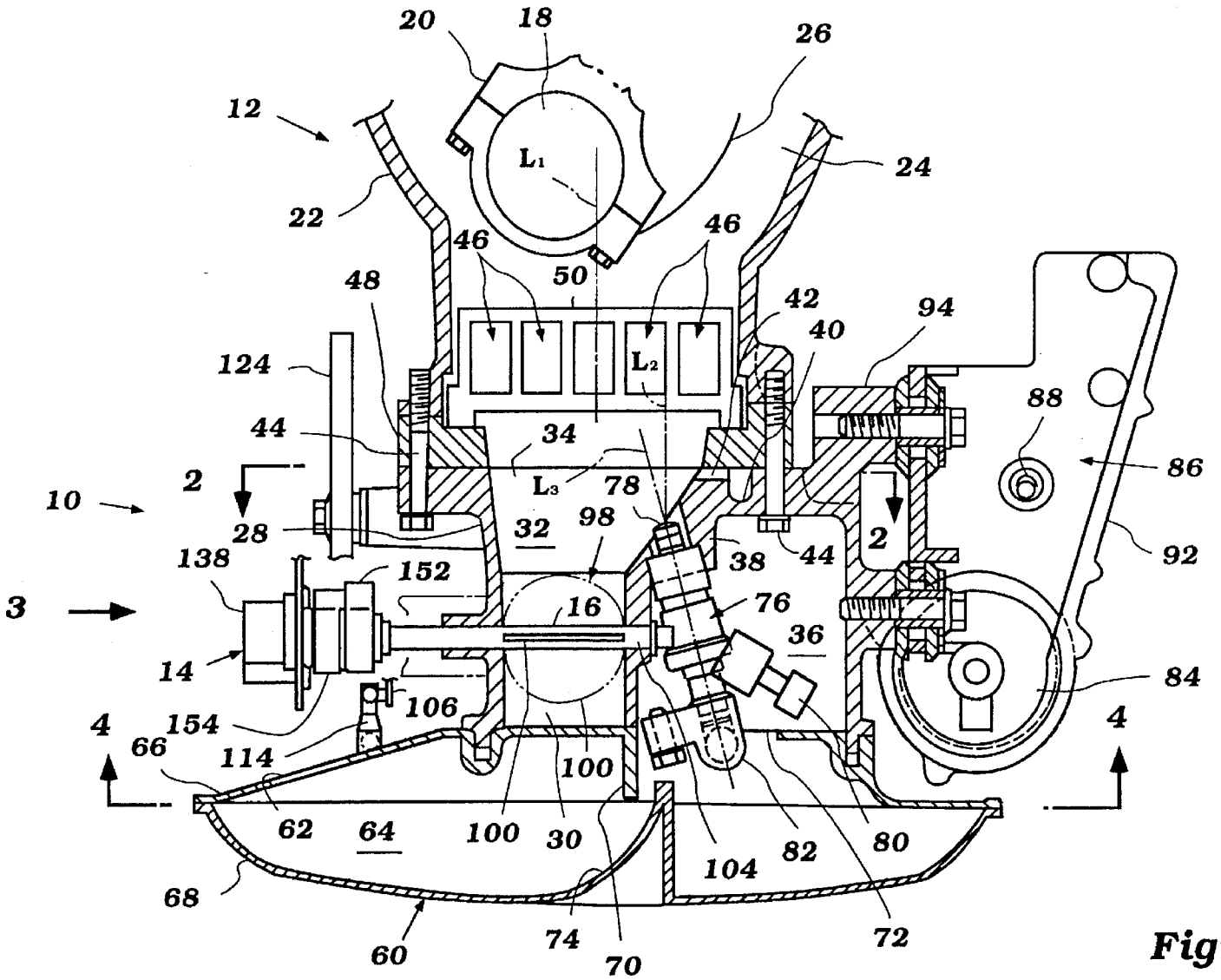
FIG. 1 is a cross-sectional, top plan view of an induction system of an engine which incorporates the throttle sensor in accordance with a preferred embodiment of the present invention.

FIG. 1 illustrates an induction system 10 for a marine engine 12 which includes a throttle sensor 14 coupled to a throttle shaft 16 of the induction system 10 in accordance with a preferred embodiment of the present invention. The present induction system 10 has particular utility with marine drives employing two-cycle, crankcase compression, vertically oriented internal combustion engines as the power unit. Because outboard motors commonly employ such engines, the present induction system 10 with the throttle sensor 14 is described below in connection with an outboard motor; however, the description of the invention in conjunction with an outboard motor is merely exemplary. Those skilled in the art will readily appreciate that the present induction system 10 can be applied to other types of engines including, but without limitation, an inboard motor of an inboard/outboard drive or an inboard drive, as well as an inboard motor of a personal watercraft.

As understood from FIG. 1, the engine is mounted conventionally with its crankshaft 18 rotating about a generally vertical axis. The crankshaft 18 drives a drive shaft (not shown) which in turn drives a propulsion device (not shown) of the outboard drive, such as, for example, a propeller or a hydrodynamic jet.

The engine 12 desirably is a reciprocating multi-cylinder engine operating on a two-cycle crankcase compression principle. The engine 12 can have any of a variety of cylinder arrangements, such as, for example, V-type, in-line or slant cylinder arrangements. The engine 12 also can operate on other than a two-cycle crankcase compression principle, such as, for example, a four-cycle principle.

The engine 12 includes a cylinder block (not illustrated in FIG. 1) which lies generally at the center of the power head of the outboard drive. The cylinder block includes a plurality of cylinder bores. Pistons reciprocate within the board and are journaled about the small ends of connecting rods 20 by means of piston pins. The big ends of the connecting rods 20 in turn are journaled about throws of the crankshaft 18.

A crankcase member 22 forms a portion of a crankcase in which the crankshaft 18 operates. The crankshaft 18 is journaled for rotation in the crankcase. The crankcase is divided into a plurality of chambers 24. As is typical with two-cycle crankcase compression engines, the crankcase chambers 24 are sealed relative to the other in a manner which includes the utilization of sealing disks 26 provided on the crankshaft 18. These disks 26 are disposed on the throws of the crankshaft 18 and separate the big ends of adjacent connecting rods 20.

Each crankcase chamber 24 communicates with a respective combustion chamber of the engine 12. Each combustion chamber has a variable volume and is defined between a recess in a cylinder head of the engine, a respective cylinder bores and the head of a respective piston. The volume of the combustion chamber varies cyclicly with the motion of the piston, as known in the art.

The induction system 10 of the engine 12 supplies a fuel/air charge to the individual crankcase chambers 24 from the crankcase side of the engine 12. As used herein, "induction system" means the system of the engine which forms and delivers a fuel/air charge (i.e., a mixture comprising fuel and air) to the engine 12. Although the induction system 10 is illustrated in connection with a crankcase compression-type engine, those skilled in the art can readily adapt the present invention to a valved engine in which the fuel/air charge is delivered directly to the combustion chamber. In the illustrated embodiment, however, the induction system 10 communicates with each crankcase chamber 24 on a side of the engine 12 opposite the cylinder bores.

Figure 2:
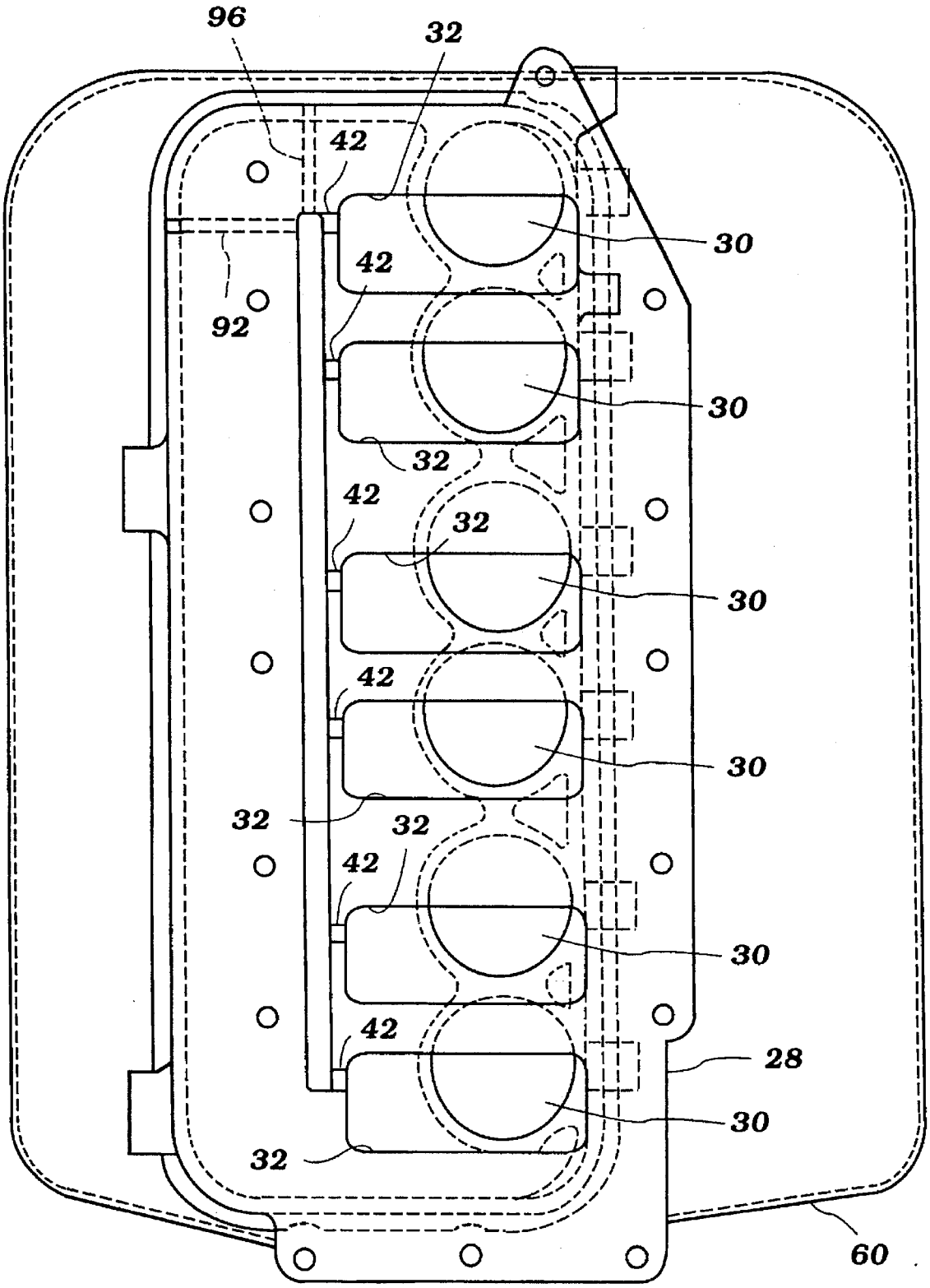
FIG. 2 is a rear elevational view of the induction system of FIG. 1 taken in the direction of line 2—2.
Figure 3:
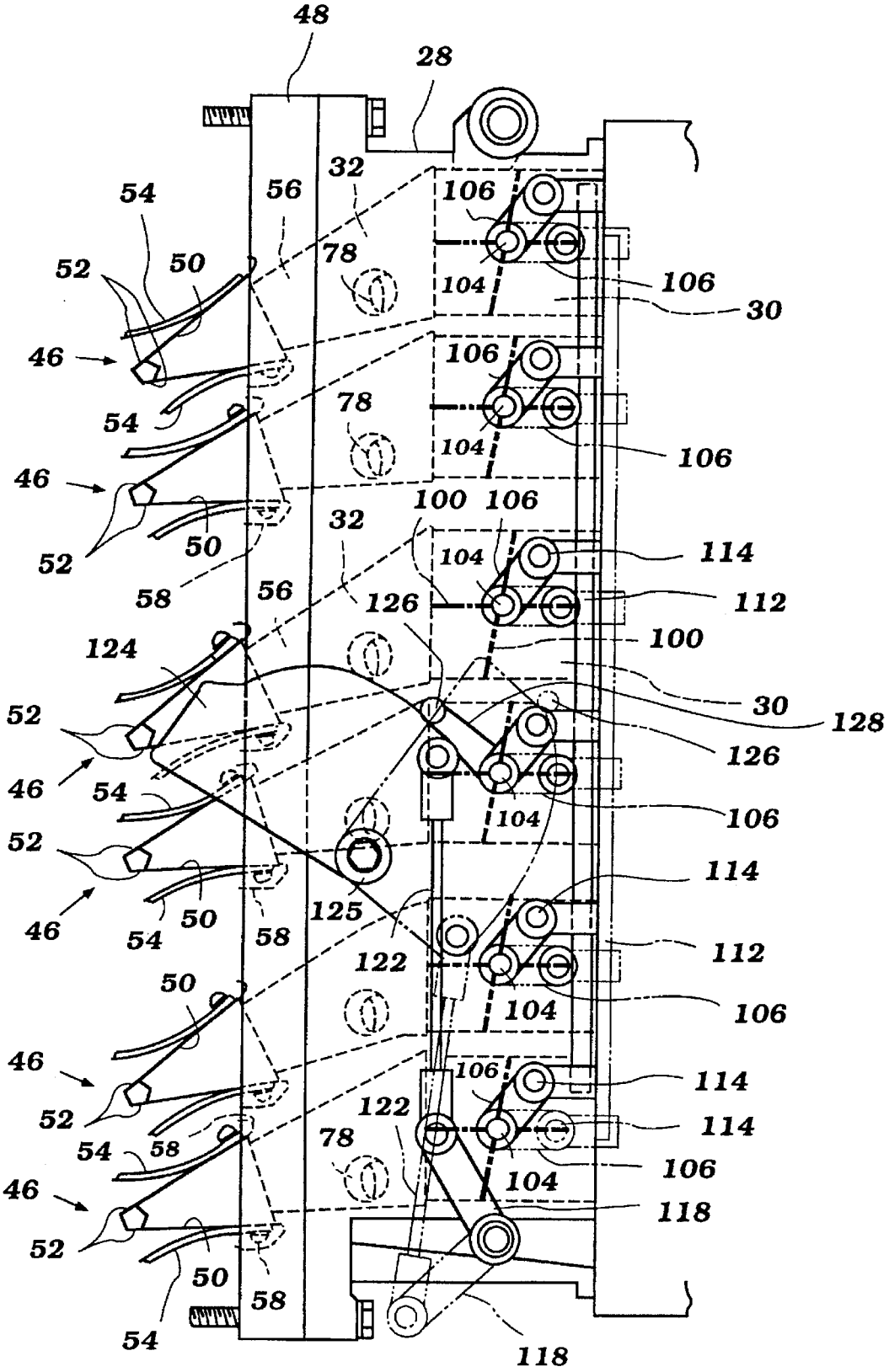
FIG. 3 is an enlarged side elevational view of the induction system taken in the direction of arrow 3 of FIG. 1.
Figure 4:
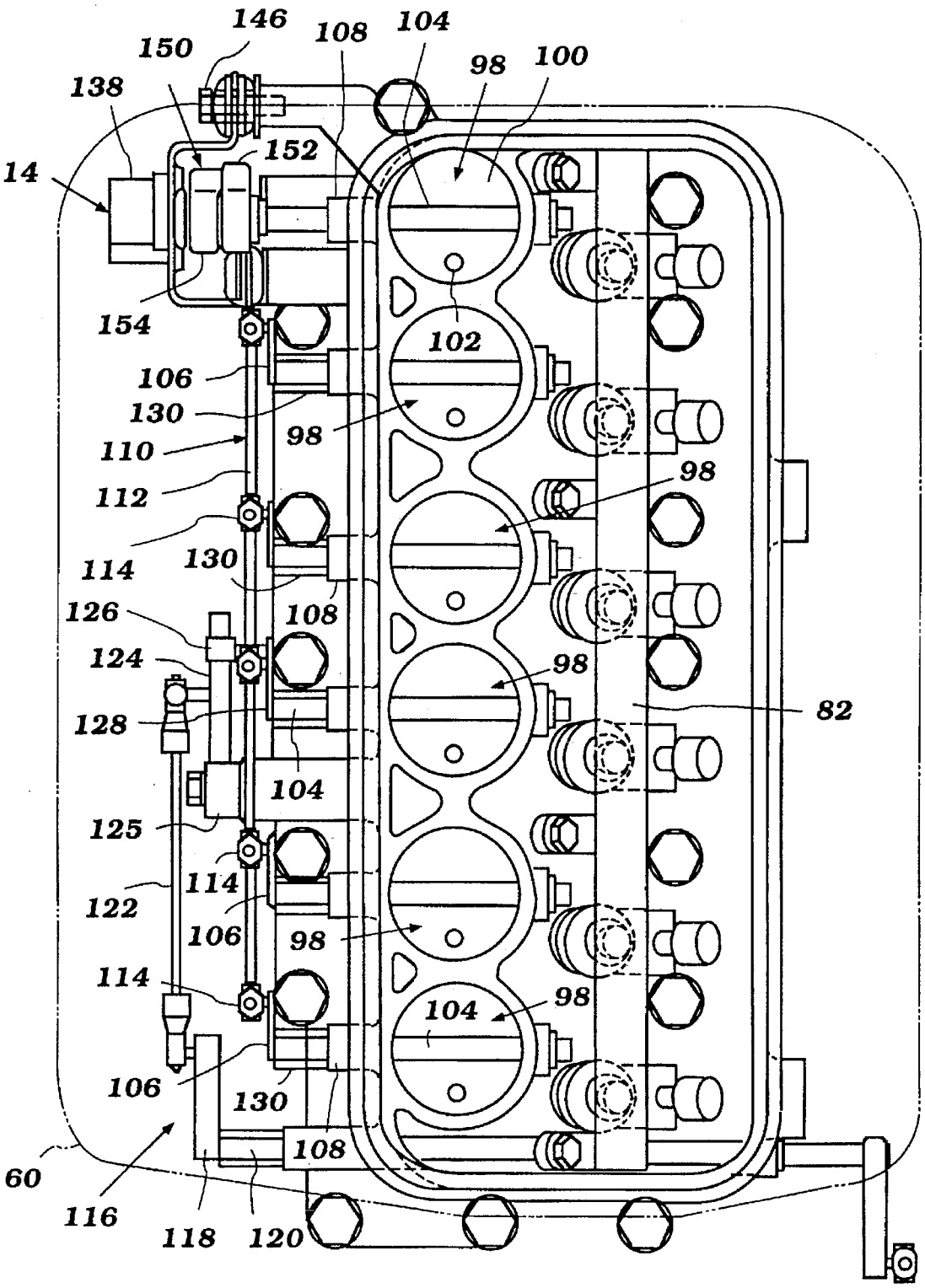
FIG. 4 is a front elevational view of the induction system taken in the direction of line 4—4 of FIG. 1 with a plenum chamber cover shown only in outline form.

As best understood from FIGS. 2–4, the induction system 10 includes an integral intake manifold 28. The manifold 28 generally defines a plurality of throttle passages 30, each of which opens into a dedicated intake passage 32. Each intake passage 32 communicates with a corresponding crankcase chamber 24 of the engine 12 through an outlet 34. The manifold 28 thus defines the same number of throttle/intake passages pairings as the number of engine combustion chambers.

In the illustrated embodiment, each throttle passage 30 has a circular cross-sectional shape (i.e., the shape of the flow area through the passage). The throttle passages 30 are aligned in a row along a generally vertical axis so as to lie above one another. The axes of the throttle passages 30 extend generally perpendicular to the vertical axis.

The intake passages 32 also are positioned in a row above one another along a generally vertical axis. As seen in FIG. 3, however, the axes of the intake passages 32 lie oblique relative to the vertical axis. An inlet of each intake passage 32 interfaces with an outlet of the corresponding throttle passage 30. The intake passage 32 thus slopes down from its inlet toward its outlet 34.

As best seen in FIGS. 1 and 2, each throttle passage 30 also is asymmetrically positioned relative to the corresponding the intake passage 32. The intake passage 32 increases in width, as seen in FIG. 1, from its inlet, which communicates with the throttle passage 30, to its outlet 34, which communicates with the respective crankcase chamber 24.

The intake manifold 28 also includes a channel 36 which extends substantially along the length of the intake manifold 28 at a position adjacent to the throttle passages 30. A plurality of bosses 38 lie within the channel 36. Each boss 38 is positioned to the side of a respective intake passage 32 and includes a mounting aperture that opens into the respective intake passage 32.

As seen in FIGS. 1 and 2, a balance passage 40. interconnects each of the intake passages 32 to balance fluid pressure between the intake passages 32. In the illustrated embodiment, the balance passage 40 includes a groove that extends along the length of the intake manifold 28 from an uppermost intake passage 32 to a lowermost intake passage 32. Side runners 42 connect the groove to each intake passage 32.

With reference to FIG. 1, bolts 44 attach an end of the intake manifold 28 to an end of the crankcase member 22 on a side opposite the engine cylinders. In this position, the intake passages 32 are placed in communication with the respective crankcase chambers 24.

Each intake passages 32 communicates with a respective crankcase chamber 24 through check valves 46. In the illustrated embodiment, the check valves 46 are reed-type valves. The reed-type valves 46 permit air to flow into the crankcase chamber 24 when the corresponding piston moves toward top dead center (TDC), but precludes reverse flow when the piston moves toward bottom dead center (BDC) to compress the fuel/air charge delivered to the crankcase chamber 24.

The reed-type valves 46 are mounted to a support plate 48 that lies between the intake manifold 28 and the crankcase member 22. The bolts 44 secure the support plate 48 to the crankcase member 22 in addition to the intake manifold 28.

As best seen in FIG. 3, each reed-type check valve 46 includes a mounting cage 50 that generally has a V-shaped configuration. An apex edge of each mounting cages 50 generally lies parallel to the flow axis through the intake passage 32. Reed-type valve plates 52 are affixed to opposite sides of the cage 50 in a suitable manner with the downstream ends of the plates 52 being able to move relative to the cage 50. Stopper plates 54 lie outside the valve plates 52 to limit the opening degree of the valve plates 52, as known in the art.

With reference to FIG. 3, the support plate 48 include apertures 56 in which the reed-type valves 46 are mounted. A well 58 is formed within each aperture 56 below the cage 50 of the reed-type valve 46. Each well 58 collects fuel which condenses in the intake passage 32. The liquid fuel later evaporates and is entrained in the fuel/air charge passing through the reed-type valve 46.

As seen in FIG. 1, an intake silencer or plenum chamber 60 is attached to the opposite side of the intake manifold 28 from the crankcase member 22 and the reed-types valves 46. The silencer 60 includes an inlet 62 positioned to the side of the intake manifold 28 so as to draw air into the induction system 10 from the interior of a cowling of the outboard motor. The inlet 62 opens into a chamber 64 which has a volume substantially larger than the volume of one of the throttle passages 30.

As seen in FIG. 1, the silencer 60 can also include an internal baffles within the chamber 64 to guide air flow toward the mouths of the throttle passages 30. In the illustrated embodiment, the silencer 60 includes a base 66 and a cover 68. A first baffle 70 is formed on the base 66 and extends toward the cover 68 at a position next to an opening 72 in the base 66 that communicates with the channel 36 of the intake manifold 28. A second baffle 74 is formed on the cover 68 and extends toward the base 66 at a position near the first baffle 70. The first and second baffles 70, 74 slightly overlap in the direction of air flow through the throttle passage 30.

At least one fuel injector 76 injects fuel into the airstream passing through each intake passage 32. In the illustrated embodiment, the bosses 38 formed in the channel 36 of the intake manifold 28 support the injectors 76. Each boss 38 receives the corresponding fuel injector 76 which is disposed so that its spray axis $L_3$ injects fuel toward a central line $L_1$ of the engine 12 and into the air flow stream through the intake passage 32 at a point downstream of the throttle passage 30.

The mounting aperture of the boss 38 receives a portion of the fuel injector 76 to support the injector 76 in this position. For this purpose, each injector 76 can include an externally threaded section which threads into the boss mounting aperture. In this position, a nozzle 78 of the fuel injector 76 is arranged inside the mounting aperture with its end lying generally flush with an inner wall of the intake passage 32. The body of the fuel injector 42 lies within the channel 36.

As understood from FIG. 1, the balance passage 40 communicates with each intake passage 32 near the point where the corresponding fuel injector 76 injects fuel into the intake passage 32 (i.e., at the point of injection). Thus, as used herein, "at the point of injection" means in the vicinity of the nozzle of the fuel injector. In this position, the runner 42 communicates with the intake passage 32 to the side of the fuel injector 76 so as not to interfere with the spray pattern of the injector 76. As seen in FIG. 1, the runner 42 opens into the intake passage 32 at a point to the side of axis $L_2$ which extends from the injector nozzle 78 and lies parallel to the center line $L_1$. Communication between the balance passage 40 with the intake passages 32 at this location improves the uniformity of the pressure within the intake passages 32 at the points where the fuel injectors 76 inject fuel into the air flow.

Each fuel injector 76 includes a solenoid winding which is energized in a conventional manner via an electrical connector 80 on the injector 76. When energized, the fuel injector 76 injects fuel into the air stream passing through the intake passage 32. An electronic control unit (ECU) of the engine 12 controls the fuel injection timing and the fuel injected amount, as described below.

A high-pressure fuel circuit of a fuel delivery system supplies fuel to each of the fuel injectors 76. In the illustrated embodiment, the high-pressure fuel circuit includes a fuel rod 82 that communicates with each of the fuel injectors 76. The fuel rod 82 desirably extends along the open end of the channel 36. Bolts secure several flanges of the fuel rod 82 to the end surface of the intake manifold 28. In this position, the fuel rod 82 covers only a portion of the channel 36 to allow air circulation within the channel 36. A portion of the fuel rod 82 also projected beyond the end surface of the intake manifold 28 into the chamber 64 defined within the intake silencer 60.

The fuel rod 82 receives pressurized fuel from a high-pressure pump 84. The high-pressure pump 84 draws fuel from a vapor separator 86 and delivers fuel to the fuel rod 82. A low-pressure pump (not shown) of the fuel delivery system supplies a fuel bowl of the vapor separator 86 with fuel from a remote fuel tank, located externally of the outboard drive and normally within a hull of an associated watercraft.

The vapor separator 86 separates fuel vapor and other gases from the liquid fuel within the fuel bowl. Gaseous vapors flow from the fuel bowl, through a vapor discharge port 88 of the vapor separator 86, through a conduit, and into a canister (not shown). A pressure-relief valve in the discharge conduit opens once the pressure of the fuel vapors within the canister reach a preselected level. With the relief valve opened, the fuel vapor flows through the conduit and discharges into the balance passage 40 through a vapor passage 90 (see FIG. 2). The vapor passage 90 is formed in the intake manifold 28 and communicates with the balance passage 40 at a point near the uppermost intake passage 32. In this manner, fuel vapor is discharged to the intake passages 32 downstream of the fuel injectors 76.

The housing 92 of the vapor separator 86 desirably houses the high-pressure pump 84. The housing 92 is attached to bosses 94 formed on the intake manifold 28. As seen in FIG. 1, bolts pass through mounting flanges of the housing 92 and secure the housing 92 to the intake manifold bosses 94 at a point proximate to the fuel rail 82.

A return line (not shown) runs from the fuel rod 82 and communicates with the vapor separator 86 to complete the high-pressure fuel circuit through which fuel is circulated. Fuel circulation in this manner minimizes heat transfer from the engine 12 to the liquid fuel.

A pressure regulator is disposed within the high-pressure fuel circuit to maintain a uniform fuel pressure at the injectors 76 (e.g., 50 to 100 atm). The regulator desirably lies downstream of the fuel rod 82 and regulates fuel pressure by controlling the circulation rate of fuel through the high-pressure fuel circuit. At idle and low load conditions, the regulator allows for a high fuel circulation rate, while with the engine 12 running under a high load condition (e.g., wide-open throttle), the regulator decreases the flow fuel flow rate through the fuel circuit. In this manner, the fuel pressure regulator maintains the fuel pressure at the injectors 76 at a generally constant level under all operating conditions between idle and wide-open throttle.

The regulator desirably includes a diaphragm valve which is held under spring and atmospheric pressure to bias the valve closed. That is, a certain pressure above atmospheric pressure is applied to the diaphragm in the regulator to close the valve. Vacuum from the engine 12 is applied to one side of the diaphragm. The vacuum works against the applied pressure to open the valve. Thus, as the atmospheric pressure changes with variations in altitude, the pressure applied to the diaphragm changes to adjust for the change in atmospheric pressure.

For this purpose, the regulator communicates with a source of air that is generally under atmospheric pressure. The regulator desirably communicates with at least one of the intake passages 32 at the point of injection in order to obtain an accurate reference of the air pressure against which the fuel injector 76 are injecting, as described below. In the illustrated embodiment, as seen in FIG. 2, the regulator communicates with balance passage 40 through a pressure passage 96 formed in the intake manifold 28. The pressure passage 96 desirably communicates with the balance passage 40 at a point near the uppermost intake passage 32. The cross-sectional flow area of the pressure passage 96 is sufficiently smaller than the cross-sectional flow area of the balance passage 40 to restrict air flow from the regulator. In this manner, the pressure applied to the regulator diaphragm is proportionate to the static pressure of the air within the balance passage 40, and hence of the air within the intake passages 32 proximate to the fuel injectors 76.

As seen in FIG. 1, the intake manifold 28 also support a plurality of throttle devices 98 which regulate air flow through the throttle passages 30. The throttle device 98 can include any of a wide variety of throttling devices, such as, for example, a sliding valve, a butterfly valve, or the like.

In the illustrated embodiment, each throttle device 98 includes a valve disc 100 which rotates within the throttle passage 30 to vary the effective flow area through the throttle passage 30. Each valve disc 100 generally has circular shape with a diameter slightly larger than the diameter of the throttle passage 30. Thus, as seen in FIG. 3, the valve disc 100 does not quite lie perpendicular to the flow through the throttle passage 30 when closed. And as seen in FIG. 4, the valve disc 100 also includes a small hole 102 positioned on the side of the valve disc 100 near the corresponding injector nozzle 76 when the valve 100 is closed. The hole 102 allows for a particular air flow into the crankcase chambers 24 when the throttle valves 98 are fully closed.

A throttle operator operates the throttle valve 98. In the illustrated embodiment, the throttle operators each include the corresponding throttle shaft 104 that supports the valve disc 100 within the passage 30 and a throttle lever 106. The throttle levers 106 desirably have an identical shape and size.

As understood from FIG. 1, each throttle shaft 104 extends through the walls of the intake manifold 28 across the respective throttle passage 30. The intake manifold 28 includes a boss 108 formed on a side of the throttle passages 30 opposite of the channel 36. The boss 108 supports a portion of the throttle shaft 104 which is suitable journaled within the boss 108. Inlet air passes through the throttle passage 30 when the throttle shaft 104 is rotated to open the valve disc 100.

Each throttle lever 106 is attached to the corresponding throttle shaft 104 of the throttle device 98. As schematically illustrated in FIG. 3, the throttle levers 106 rotate from a closed position to a wide-open position in which the valve 100 lies generally parallel to the air flow through the throttle passage 30. The throttle levers 106 and associated shafts 104 rotate through a little less than 90° (e.g., 80°) to move the corresponding valves 100 between the fully closed position and the wide-open position.

A throttle synchronization mechanism desirably operates the throttle valves in unison. The throttle synchronization mechanism includes a throttle linkage 110 connected to the throttle operators 104 so as to uniformly and simultaneously operate and control the throttle valves 98. In the illustrated embodiment, the throttle linkage 110 is coupled to each of the throttle levers 106 and lies generally parallel to the fuel rod 82. Both the fuel rod 82 and the throttle linkage 110 also extend in directions which are generally parallel to the row of throttle passages 30. In order to simplify the construction of the induction system 10, the throttle linkage 110 desirably lies on a side of the intake manifold 28 opposite of the fuel rod 82.

The throttle linkage 110 comprises an elongated link 112. In the illustrated embodiment, the link 112 is a straight metal linkage rod. The linkage rod 112 has a length slightly smaller than the height of the intake manifold 28.

A plurality of lugs 114 extend from the link 112. In the illustrated embodiment, each lug 114 includes a mounting aperture through which a portion of the link 112 passes. The lugs 114 are positioned at various points along the link 112 which correspond with the position of the associated throttle lever 106. The lugs 114 can be resin-bonded to the link 112, or can be releasably fixed in place along the link 112 by conventional set-screws or like means. With the latter form of attachment, the throttle valve discs 100 can be synchronized by adjusting the position of the corresponding lugs 114 along the length of the link 112.

Each lug 114 extends to the side of the link 112. A connector is formed at an outer end of the lug 114. The connector is configured to attach to the lever 106 in a manner allowing rotation between the lever 106 and the lug 114. The point of attachment between the lug 114 and the lever 106 desirably is offset from the longitudinal axis of the link 112.

The connector desirably comprises an aperture which engages a snap positioned on the end of the corresponding throttle lever 106. The connector of the lug 114 receives the snap head in a snap-fit manner to inhibit disengagement between the lug 114 and the lever 106, while allowing the lug 114 and the lever 106 to rotate relative to each other.

As seen in FIG. 3, each lug 114 connects to the corresponding lever 106 of the throttle operator. The position of the lugs 114 along the length of the link 112 correspond to the position of an engagement end of the lever 106 on which the snap is formed with the throttle valve 98 lying at the same angular position.

An actuator mechanism 116 of the throttle valve synchronization system actuates the throttle linkage 110. The actuator mechanism 116 includes an actuator lever 118 which is fixed to an actuator shaft 120 that extends through the intake manifold 28. The actuator lever 118 can be operated by a conventional throttle controller including bowden-wire cables operating at the other end of the actuator shaft 120.

A linkage rod 122 connects the actuator lever 118 to a rotatable cam 124. The cam 124 rotates about a support shaft 125 fixed to the exterior of the intake manifold 28. As seen in FIG. 3, the cam 124 includes an arcuate cam surface positioned on an outer edge of the cam 124.

A follower 126 cooperates with the cam surface to move over the cam surface as the cam 124 is rotated by the actuator lever 118. The follower 126 is connected to a second actuator lever 128 which is coupled to one of the throttle levers 106. The second actuator lever 128 desirably is coupled to the throttle lever 106 in a manner which causes the actuator lever 128 and the throttle lever 106 to move together. In the illustrated embodiment, these two levers are jointed together such that the throttle lever 106 rotates with the actuator lever 128. The actuator lever 128 thus also rotates the corresponding throttle shaft 104 and valve 100.

A biasing mechanism 130 desirably biases the throttle valves 100 to the closed position. The biasing mechanism 130 desirably is one or more torsion springs disposed between the throttle levers 106 and the intake manifold 28. The biasing mechanism 130 acts against the movement imparted to the linkage system 110 by the actuator mechanism 116.

The throttle valve angle sensor 14 cooperates with the throttle linkage 110 to sense the opening degree of the throttle valves 98. The throttle angle detector 14 communicates with the electronic control unit (ECU) to control the desired air/fuel ratio.

Figure 5:
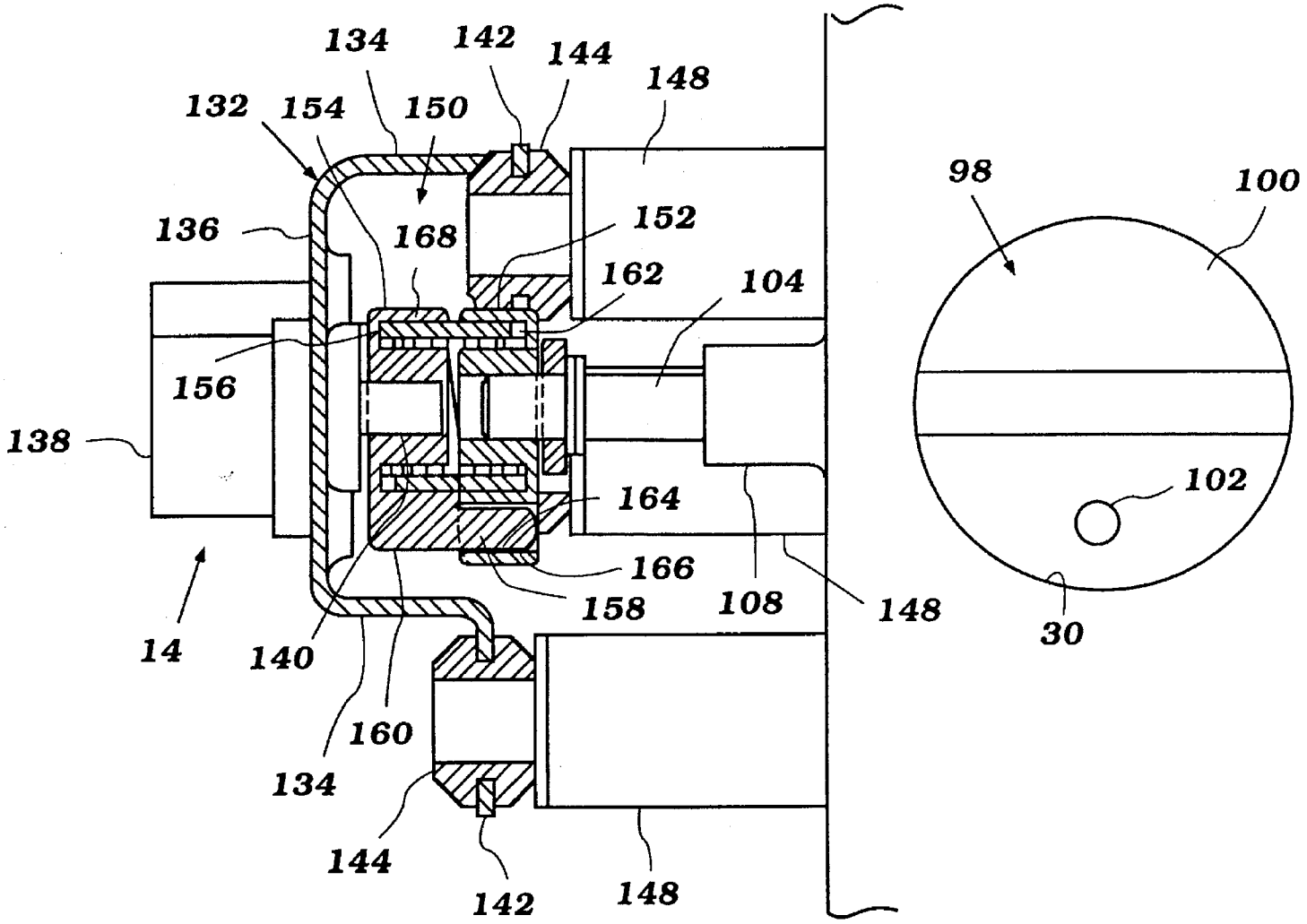
FIG. 5 is a top plan, partial sectional view of the throttle sensor of FIG. 1 illustrating a coupling between a throttle shaft of the induction system and a shaft of the throttle sensor.

With reference to FIG. 1 and 5, the throttle sensor 14 is attached to one of the throttle shafts 104 on the same side of the intake manifold 28 on which the throttle linkage 110 lies, in order to reduce the size of the engine 12. The throttle sensor 14 does not interfere with the position or arrangement of the fuel injectors 76 or the fuel rod 82 in this position. As seen in FIG. 1, the throttle sensor 14 also lies within a space existing directly behind the silencer 60 and above the actuator mechanism 116. In this position, the sensor 14 does not increase the size of the engine 12.

As best seen in FIG. 5, a bracket 132 supports the throttle sensor 14 to the side of the throttle linkage 110 and at an outer end of the throttle shaft 104. In the illustrated embodiment, the throttle sensor 14 is coupled to the throttle shaft 104 of the uppermost throttle device 98 which lies nearest an influent port of the fuel rail 82 (FIG. 1) at the upper end of the rail 82. Thus, the uppermost cylinder determines the amount of fuel injected. Because the injector 76 of the uppermost cylinder is portion near the influent port of the fuel rail 82, fuel pressure at the injector 76 is generally unaffected by the pulsation of fuel pressure produced by the fuel injectors 76 positioned downstream. Sensing the uppermost cylinder thus provides highly accurate fuel injection control.

In the illustrated embodiment, the bracket 132 includes three legs 134 which support a platform 136. Screws connect the sensor body 138 to the platform 136. The body 138 of the throttle sensor 14 includes a pair of slots which receive the screws. In this manner, the position of the throttle sensor 14 on the bracket 132 can be adjusted to precisely align a shaft 140 of the throttle sensor 14 with the corresponding throttle shaft 104.

Each leg 134 includes a footing 142 having a mounting aperture. A grommet 144 extends through the mounting aperture to elastically support the bracket 134. And as best seen in FIG. 4, a bolt 146 extends through each grommet 144 and mounting hole to secures the associated footing 142 to a boss 148 formed on the intake manifold 28. This elastic coupling reduces the amount of engine vibration, as well as heat, transfer from the intake manifold 28 to the throttle sensor 14.

The legs 134 of the bracket 132 are arranged so as not to interfere with the operation of the throttle linkage 110. For this purpose, as best seen in FIG. 5, the legs 134 support the platform 136 away from the throttle lever 106.

The shaft 140 of the throttle sensor 14 is connected to the throttle shaft 104 by a unique coupling 150. Although not shown, a dust boot desirably encloses the coupling 150 to protect the coupling 150 and the sensor shaft 140.

The coupling 150 desirably includes a driver and a follower. The driver is connected to the throttle shaft 104 so as to rotate with the throttle shaft 104. The connection can be accomplished in any known manner, such as, by a key, a pin, a spline connection, set-screw, a press-fit engagement, or like connection. The connection between the driver and the throttle shaft 104 should not permit any slippage or play to occur between these components.

The follower is connected to the shaft 140 of the sensor 14 in a similar manner. The sensor shaft 140 and the follower rotate together with no slippage or play occurring between these components.

The follower and the driver together include interengaging elements that couple the driver and the follower so as to rotate together. The interengagement between the interengaging elements, however, desirably allows the driver and the follower to move relative to each other in the axial direction. Engagement and disengagement between the interengaging element thus can be accomplished by moving the follower and the driver relative to each other in this direction.

A biasing member is provided between the follower and the driver. The biasing member desirably is coupled to the follower and the driver and biases the follower to follow the rotational movement of the driver.

In the illustrated embodiment, the follower and the driver each comprise a drum 152, 154 with a mounting aperture that cooperates with the corresponding throttle or sensor shaft 104, 140, respectively. The follower drum 154 includes an annular groove 156 that circumscribes the mounting aperture. The follower drum 154 also includes a pin 158 extending toward the driver drum 152 from an eccentric portion 160 of the follower drum 154. In this position, the pin 158 is off-set from an axis of the mounting aperture (i.e., is eccentrically positioned relative to the axis). As best understood from FIG. 1, the follower drum 154 thus have an out-of-round shape.

The driver drum 152 also has an out-of-round shape and includes an annular groove 162 that circumscribes the mounting aperture. The annular groove 162 of the driver drum 152 is positioned to oppose the annular groove 156 of the follower drum 154 when assembled. The driver drum 152 also includes a receptacle 164 that receives the pin 158 of the follower drum 154. The receptacle 164 is formed in an eccentric portion 166 of the driver drum 152. Although the pin 158 and the receptacle 164 desirably have about the same diameters, tolerances and the desire for a smooth engagement between these components inevitably results in some looseness occurring between the pin 158 and the receptacle 164.

The biasing member desirably comprises a helical torsion spring 168 positioned within the annular grooves 156, 162 between the follower drum 154 and the driver drum 152. In this position, the biasing member 168 is contained between the follower and driver drums 154, 152.

The ends of a plain end spring 168 desirably act against abutments formed on the bottom surface of the annular grooves 156, 162 to couple the spring 168 to the corresponding drums 152, 154. The spring 168 is at least partially wound in this position to bias pin 158 of the follower drum 154 against a wall of driver drum receptacle 164. Alternatively, clips, which are disposed at the bottom of the grooves 156, 162, can be used to releasably couple the ends of the spring 168 to the drums 152, 154, especially if a spring with ground ends is used. In either embodiment, the spring 168 is wound between both drums 152, 154 in a manner biasing the pin 158 against a wall of the receptacle 164.

In this manner, the drums 152, 154 rotate in unison regardless of any looseness between the pin 158 and the receptacle 164. The wall of the receptacle 164 acts directly against the pin 158 when the driver drum 152 is rotates in one direction, and the spring 168 biases the pin 158 against the receptacle wall when the driver drum 152 rotates in the opposite direction. The driver drum 152 and the follower drum 154 thus move as a unit (i.e., in unitary manner) without any rotational movement occurring between the drums 152, 154.

The integral rotation of the follower and the driver eliminates hysteresis in the sensed position of the throttle valve 100 as the linkage system 110 opens and closes the throttle valves 100. That is, the movement of the sensor shaft 140 precisely tracks the movement of the corresponding throttle shaft 104 as the throttle valve 100 is opened and as the throttle valve is closed. The sensor shaft 140 does not lag the throttle shaft 104 in either rotational direction. The sensor 14 consequently can determine the precise position of the throttle shafts 104.

The following elaborates on the operation of the present induction system 10 and the electronic control thereof. To open the throttle valves 100, the first actuator lever 118 is rotated to operate the throttle linkage 110. The linkage rod 122 imparts the rotational movement of the first actuator lever 118 to the cam 124. The follower 126 of the second actuator lever 128 slides over the cam surface with rotation of the cam 124, and the second actuator lever 128 consequently rotates. Rotation of the second actuator lever 128 opens the attached throttle valve 100.

The associated throttle lever 106 transmits this rotational movement to the throttle linkage 110. The throttle linkage 110 moves downward, in the illustrated embodiment, as a result. This downward movement of the link 112 causes the balance of the throttle levers 106 to rotate. The lugs 114 of the linkage system 110 transmit the downward movement of the link 112 to the outer end of the levers 106.

The unitary movement of the lugs 114, which are rigidly connected to each other by the link 112, causes the throttle levers 106 to move in unison. The throttle valves 110 simultaneously open with the opening degree between each valve 100 being substantially the same.

Air flows into the silencer chamber 64 through the silencer inlet 62 when the throttle valves 100 are opened. The second baffle 74 guides the air around toward the mouths of the throttle passages 30. The first baffle 70 then directs the majority of the air flow into the throttle passages 30. A portion of the air guided toward the intake manifold 28 by the second baffle 74 also circulates within the channel 36, for cooling the fuel rod 82 and fuel injectors 76.

The engine 12 draws air into each crankcase chamber 24 through the corresponding throttle device 98, intake passage 32 and reed-type valve 46 as the piston moves toward top dead center. The fuel injectors 76 inject fuel into the air stream passing through the intake passages 32. The ECU controls the timing and the amount of fuel injected depending upon the amount of air which the engine draws.

The throttle sensor 14 detects the position of the uppermost throttle shaft 104 throughout its range of movement in order to determine the amount of air which the engine draws. In operation, the driver drum 152 rotates with the corresponding throttle shaft 104. The wall of the receptacle 164 acts directly against the pin 158 which causes the follower drum 154 to rotate with the driver drum 142. The biasing member 168 holds the pin 158 against the wall when the driver drum 152 moves in the opposite direction.

Because of the synchronization between the throttle shafts 104 produced by the throttle linkage 110, the position of the uppermost throttle shaft detected by the throttle sensor 14 is indicative of the position of the other throttle shafts 104. The throttle sensor 14 produces a signal indicative of this position which the ECU receives and processes to determine the intake air flow into the engine 12 at a given time. The ECU uses this information to adjust the amount of fuel injected into the intake passages 32 by the injectors 76 in order to produce a fuel/air charge of a desired fuel/air ratio.

In addition, the pressure regulator maintains the fuel pressure at the injectors 76 at a specific pressure above atmospheric pressure. The ECU thus can adjust the time duration for which a valve of the fuel injector 76 is opened (i.e., the time for which the solenoid of the fuel injector is energized) in order to control the amount of fuel injected, without accounting for changes in the pressure differential between the fuel pressure and the air pressure at the injector nozzle 78 caused by differing atmospheric pressures. The injectors 76 consequently can delivery a more precise amount of fuel into the air stream.

Figure 6:
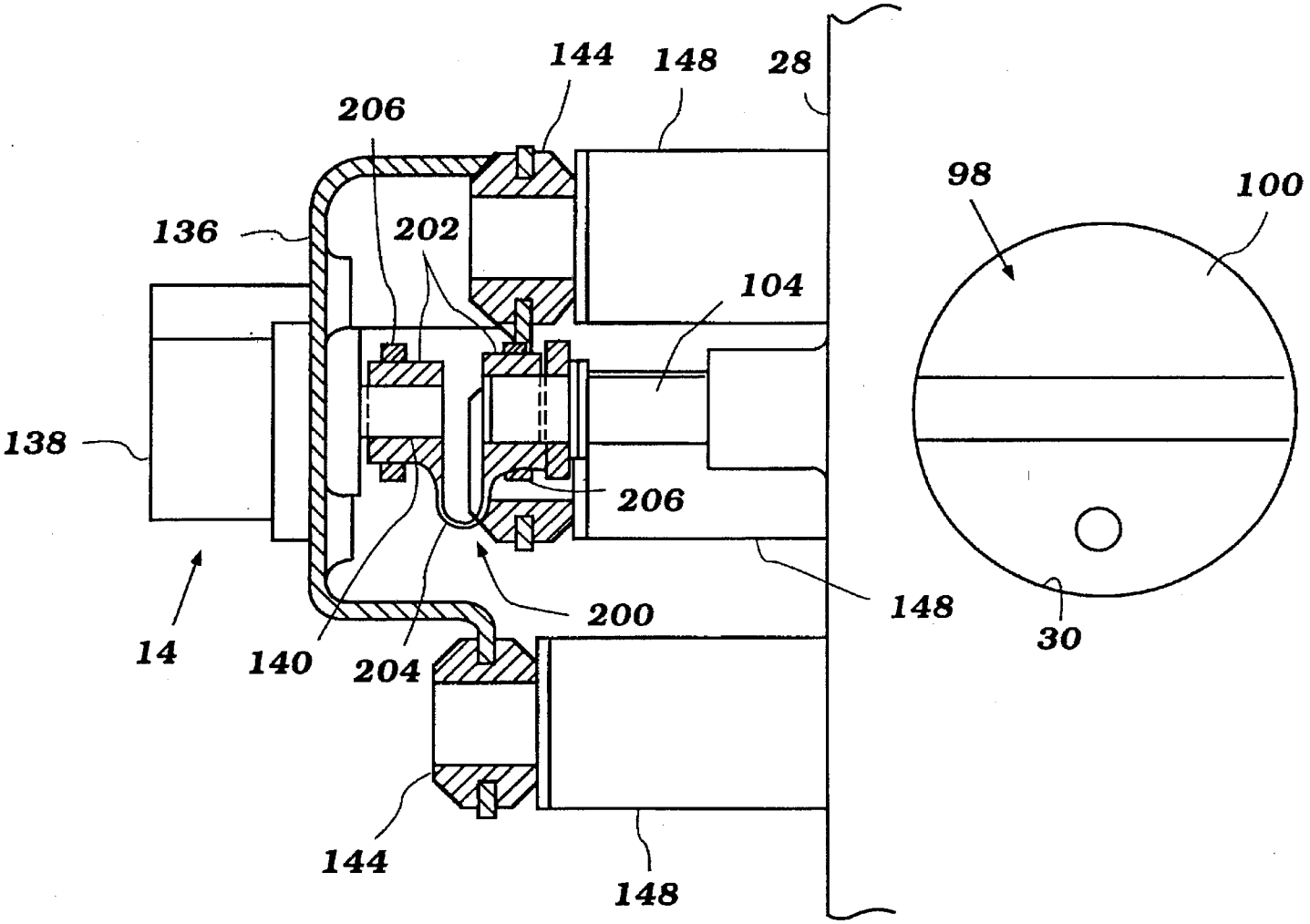
FIG. 6 is a top, partial sectional view of a conventional coupling between a throttle shaft and a shaft of a throttle sensor.

In order to more fully appreciate the advantages of the present coupling 150 between the throttle sensor 14 and the throttle shaft 104, a further explanation of conventional couplings is provided below. FIG. 6 illustrates the band type coupling 200 described above used in connection with the above-described arrangement of the throttle device, intake manifold, support bracket and sensor device. Like reference numerals have been used to indicated like parts in order to ease the readers understanding of this figure; however, only the band coupling 200 is believed to conventional.

The coupling 200 includes a pair of rings 202 interconnected by a thin band 204. Each ring 202 is attached to the corresponding shaft by a pin 206. The pin 206 passes through the ring 204 and the corresponding shaft.

As noted above, the thin band 204 commonly propagates high-frequency engine vibrations which it transmits to the throttle sensor 14. Such vibrations negatively effect the performance of the throttle sensor 14. In addition, the thin band 204 commonly twists slightly when the throttle shaft 104 rotates. The shaft 140 of the throttle sensor 14 thus follows the throttle shaft 104 with a slight delay. As a result, hysteresis occurs in the sensed position of the throttle shafts 104 as the throttle valves 100 open and close which produces inaccuracies in the sensed position of the throttle devices 98.

The present coupling 150 does not suffer from these drawbacks. The large size and sturdiness of the coupling 150, as compared to the thin band coupling 200, tends to dampen high-frequency engine vibrations and is not easily deformed. Mechanical hysteresis caused by deformation in the coupling thus does not occur. The sensor 14 as a result measures the angular position of the throttle shaft 104 more precisely and accurately.

Figure 7:
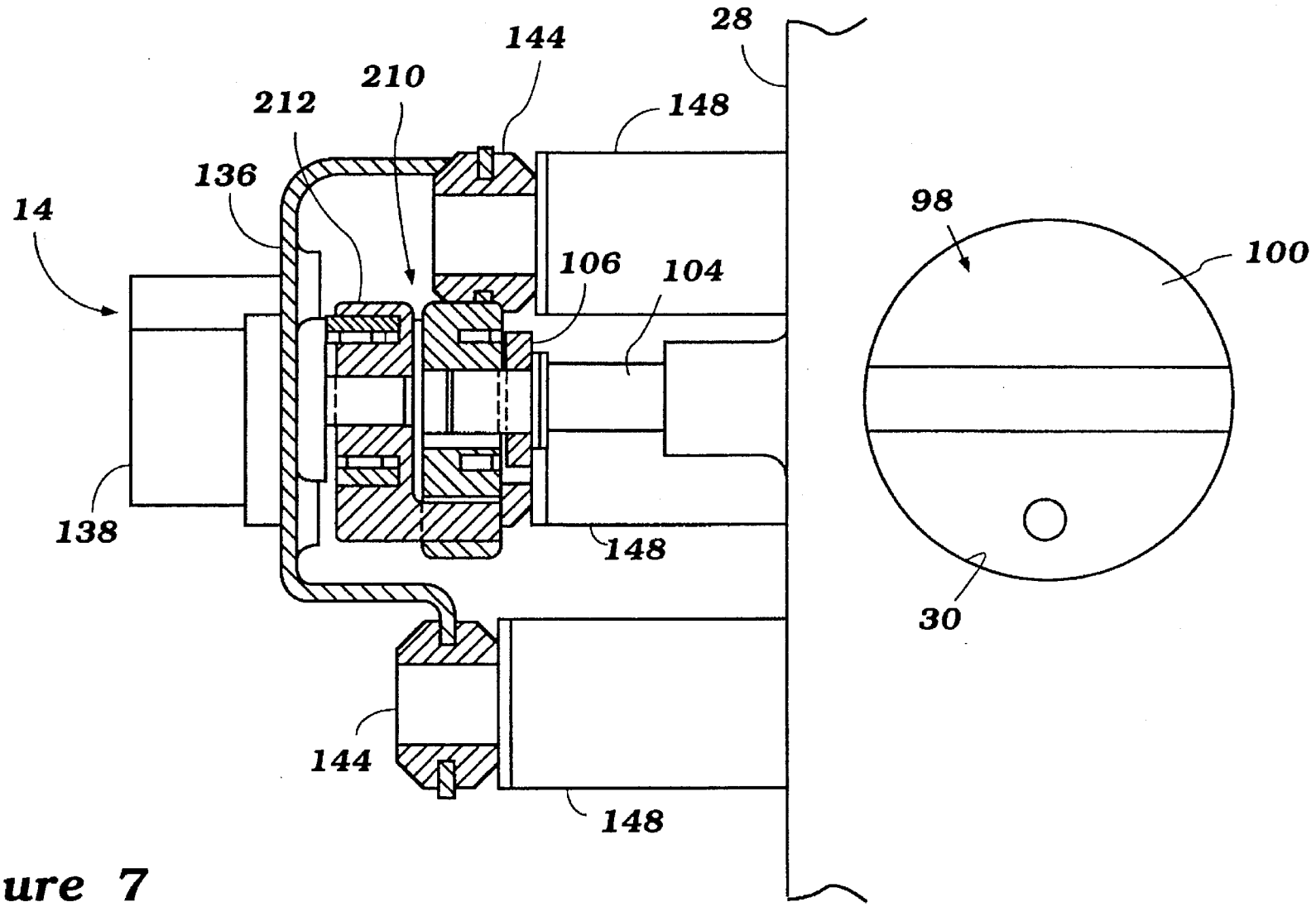
FIG. 7 is a top plan, partial sectional view of another coupling between a throttle shaft and a throttle sensor shaft.

FIG. 7 illustrates another coupling 210 suggested to overcome the problems associated with the thin band coupling 200. This coupling 210 uses a dual-drum construction similar to that described above in connection with the embodiment of FIG. 5. In this design, however, a bias spring 212 operates between a drum 214 and the sensor body 138. A return spring (not shown in FIG. 7, but similar to the spring 130 illustrated in FIG. 4) also operates between the throttle lever 106 and the intake manifold 28, and opposes the bias spring 212 acting between the drum 214 and the sensor 14. As a result, the bias spring 214 reduces the return force supplied by the return spring applied to the throttle shaft 106. The return forces acting on the throttle shafts 104 thus varies between the throttle shafts 104. Variation in throttle valve position consequently occurs and introduces inaccuracies in the sensed throttle valve position because all of the throttle valves may not move in unison.

In the coupling design 150 of FIG. 5, the biasing member 168 acts between the drums 152, 154 and does not work against the return spring 130 which moves the throttle valve 100 to the closed position. The present coupling 150 therefore improves the accuracy of the sensed throttle position.

Although this invention has been described in terms of certain preferred embodiments, other embodiments apparent to those of ordinary skill in the art are also within the scope of this invention. For instance, it is contemplated that the present sensor/operator coupling can be employed with other types of engine control devices as well, in addition to the throttle device described above. Accordingly, the scope of the invention is intended to be defined only by the claims that follow.

What is claimed is:

1. An engine comprising an induction system including at least one throttle device, said throttle device comprising a throttle shaft that rotates to establish an opening degree of the throttle device, and a sensor comprising a rotatable sensor shaft and a coupling which interconnects said sensor shaft to said throttle shaft such that said sensor shaft rotates with said throttle shaft in a unitary manner, said coupling comprising a driver attached to the throttle shaft and a follower attached to the sensor shaft, said driver and said follower including interengaging elements which connect said follower to said driver such that said follower rotates with said driver, and a biasing member provided between said driver and said follower to bias said follower to follow rotational movement of said driver.

2. An engine as in claim 1, wherein said induction system comprises a plurality of throttle device interconnected by a linkage system.

3. An engine as in claim 1, wherein said interengaging elements are configured to permit said driver to move relative to said follower in a direction generally parallel to an axis of the operator shaft.

4. An engine as in claim 1, wherein said interengaging elements comprise a pin connected to one of said driver and said follower, and a hole formed in the other one of said driver and said follower.

5. An engine as in claim 4, wherein said driver comprises a first drum attached to the throttle shaft and said follower comprises a second drum attached to the sensor shaft of the sensor.

6. An engine as in claim 5, wherein said drums are arranged to operate about a common axis which coincides with axes of the sensor shaft and the throttle shaft.

7. An engine as in claim 6, wherein said pin and said hole are eccentrically positioned relative to said common axis.

8. An engine as in claim 7, wherein said biasing member comprises a helical torsion spring having first and second ends, said first end being coupled to said first drum and said second end being coupled to said second drum.

9. An engine as in claim 7, wherein said helical torsion spring is contained between said first and second drums.

10. An engine comprising an induction system including a plurality of throttle devices interconnected by a linkage system, each throttle device comprising a throttle shaft that rotates to establish an opening degree of the corresponding throttle device, a throttle sensor having a rotatable sensor shaft, and means for transferring reciprocating rotational movement of one of said throttle shafts to said sensor shaft without producing mechanical hysteresis.

11. A coupling between a sensor and an operator of an engine control device which moves between at least two positions, said coupling comprising a driver attached to the operator and a follower attached to the sensor, said follower and said driver cooperating with each other to transfer movement of the operator to the sensor, and a biasing member provided between said driver and said follower to bias said follower to follow movement of said driver.

12. A coupling as in claim 11, wherein said coupling is intended to couple an input shaft of the sensor to a rotatable operator shaft of the operator, and said driver and said follower of said coupling include interengaging elements which connect said follower to said driver such that said follower rotates with said driver while said driver is able to move relative to said follower in a direction generally parallel to an axis of the operator shaft.

13. A coupling as in claim 12, wherein said driver comprises a first drum attached to the operator shaft and said follower comprises a second drum attached to the input shaft of the sensor, and said interengaging elements comprises a pin connected to one of said first and second drums, and a hole formed in the other one of said first and second drums.

14. A coupling as in claim 13, wherein each drum is coaxially aligned with the axis of the corresponding input shaft or operator shaft to which the drum is attached.

15. A coupling as in claim 13, wherein said drums are arranged to operate about a common axis.

16. A coupling as in claim 15, wherein said common axis is positioned to coincide with axes of the input shaft and the operator shaft.

17. A coupling as in claim 16, wherein said pin and said hole are eccentrically positioned relative to said common axis.

18. A coupling as in claim 13, wherein said biasing member comprises a helical torsion spring having first and second ends, said first end being coupled to said first drum and said second end being coupled to said second drum.

19. A coupling as in claim 18, wherein at least one of said first and second ends is removably connected to the corresponding first and second drum.

20. A coupling as in claim 18, wherein said helical torsion spring being contained between said first and second drums.

21. An engine comprising an induction system including a plurality of intake passages and at least one fuel injector which communicates at an injection point with at least a first intake passage of said plurality of intake passages, and a fuel delivery system communicating with said fuel injector, said fuel delivery system including a pressure regulator which communicates with at least said first intake passage at the point of injection.

22. An engine as in claim 21, wherein said induction system additionally comprises a balance passage which interconnects said intake passages to one another.

23. An engine as in claim 22, wherein said induction system comprises a plurality of fuel injectors, at least one of the fuel injectors communicates with one of the intake passages at a point of injection within that intake passage, and the balance passage communicates with each intake passage at the corresponding point of injection within each intake passage.

24. An engine as in claim 23, wherein said pressure regulator communicates with each intake passage through the balance passage.

25. An engine as in claim 22, wherein said fuel delivery system additionally comprises a vapor separator having a vapor discharge port, and the vapor discharge port communicates with the balance passage to deliver fuel vapor to each intake passage.

26. An engine as in claim 25, wherein said induction system comprises a manifold in which said intake passages are formed, said manifold also defines said balance passage and supports said fuel injectors.

27. An engine as in claim 26, wherein said intake passages are vertically aligned above one another within said manifold.

28. An engine as in claim 27, wherein said vapor discharge port of said vapor separator communicates with said balance passage through a vapor passage formed in said manifold, and said vapor passage communicates with said balance passage at a point near an uppermost intake passage.

29. An engine as in claim 27, wherein said pressure regulator of said fuel delivery system communicates with said balance passage through a pressure passage, and said pressure passage communicates with said balance passage at a point near an uppermost intake passage.

30. An engine as in claim 22, wherein each intake passage communicates with a corresponding variable volume chamber of said engine through a check valve, and said balance passage communicates with each intake passage upstream of the check valve.

* * * * *

UNITED STATES PATENT AND TRADEMARK OFFICE

CERTIFICATE OF CORRECTION

PATENT NO. : 5,655,500
DATED : August 12, 1997
INVENTOR(S) : Masahiko Kato

It is certified that error appears in the above-indentified patent and that said Letters Patent is hereby corrected as shown below:

Column 14, line 60, Column 16, line 20, delete claims 21-30--

Signed and Sealed this

Twenty-fifth Day of August, 1998

Bruce Lehman

*Attest:*

BRUCE LEHMAN

*Attesting Officer*

*Commissioner of Patents and Trademarks*